US005264334A

United States Patent [19]

Przezdziecki et al.

[11] Patent Number: 5,264,334

[45] Date of Patent: Nov. 23, 1993

[54] THERMALLY PROCESSABLE IMAGING ELEMENT COMPRISING A BARRIER LAYER

[75] Inventors: Woiciech M. Przezdziecki, Pittsford; Jean Z. DeRuyter, Spencerport, both of N.Y.

[73] Assignee: Eastman Kodak Company, Rochester, N.Y.

[21] Appl. No.: 20,912

[22] Filed: Feb. 22, 1993

[51] Int. Cl.[5] ..... G03C 1/76

[52] U.S. Cl. ..... 430/523; 430/536; 430/619; 430/620; 430/627

[58] Field of Search ..... 430/536, 519, 620, 627, 430/523

[56] References Cited

U.S. PATENT DOCUMENTS 4,741,992 5/1988 Przezdziecki ..... 430/523
4,828,971 5/1989 Przezdziecki ..... 430/531
4,857,439 8/1989 Dedio et al. ..... 430/619
4,886,739 12/1989 Przezdziecki ..... 430/617
4,942,115 9/1990 Przezdziecki ..... 430/523

*Primary Examiner*—Janet C. Baxter
*Attorney, Agent, or Firm*—Alfred P. Lorenzo

[57] ABSTRACT

Thermally processable imaging elements in which the image is formed by imagewise heating or by imagewise exposure to light followed by uniform heating and in which a polyalkoxysilane is incorporated in the imaging composition to provide enhanced adhesion are protected against undesirable width-wise curling by interposing a barrier layer between the support and the image-forming layer. The barrier layer, which is composed of poly(silicic acid) and a water-soluble hydroxyl-containing monomer or polymer that is compatible therewith prevents migration from the image-forming layer to the support of by-products of hydrolysis of the polyalkoxysilane which can cause width-wise curl and consequent jamming of processing equipment.

20 Claims, No Drawings

THERMALLY PROCESSABLE IMAGING ELEMENT COMPRISING A BARRIER LAYER

CROSS-REFERENCE TO RELATED APPLICATIONS

A novel method for the manufacture of a thermographic or photothermographic element in which a pre-hydrolyzed polyalkoxysilane is incorporated in the imaging composition is disclosed and claimed in copending commonly assigned U.S. patent application Ser. No. 08/020,911, filed Feb. 22, 1993, "Method For The Manufacture Of A Thermally Processable Imaging Element" by Wojciech M. Przezdziecki and Jean Z. DeRuyter.

FIELD OF THE INVENTION

This invention relates in general to imaging elements and in particular to thermally processable imaging elements. More specifically, this invention relates to imaging elements comprising a thermographic or photothermographic layer which include a protective overcoat layer and which are protected against undesirable width-wise curling.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure*, June 1978, Item No. 17029 and U.S. Pat. Nos. 3,080,254, 3,457,075 and 3,933,508.

An important feature of the aforesaid thermally processable imaging elements is a protective overcoat layer. To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element.

A particularly preferred overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the imaging layer as described in U.S. Pat. No. 4,828,971, issued May 9, 1989.

One of the most difficult problems involved in the manufacture of thermally processable imaging elements is that the protective overcoat layer typically does not exhibit adequate adhesion to the imaging layer. The problem of achieving adequate adhesion is particularly aggravated by the fact that the imaging layer is typically hydrophobic while the overcoat layer is typically hydrophilic. One solution to this problem is that described in U.S. Pat. No. 4,886,739, issued Dec. 12, 1989, in which a polyalkoxysilane is added to the thermographic or photothermographic imaging composition and is hydrolyzed in situ to form an $Si(OH)_4$ moiety which has the ability to crosslink with binders present in the imaging layer and the overcoat layer. Another solution to the problem is that described in U.S. Pat. No. 4,942,115, issued Jul. 17, 1990, in which an adhesion-promoting layer, in particular a layer composed of an adhesion-promoting terpolymer, is interposed between the imaging layer and the overcoat layer.

The known solutions to the problem of providing adequate overcoat adhesion with thermally processable elements exhibit certain disadvantages which have hindered their commercial utilization. For example, while incorporation of a polyalkoxysilane in the imaging composition brings about a gradual increase in adhesion on aging of the element, the in situ hydrolysis of the polyalkoxysilane is slow and its rate is limited by the availability of water in the coated layer. Moreover, the alcohol which is formed as a by-product of the hydrolysis, for example, the ethyl alcohol that is formed by hydrolysis of tetraethoxysilane, is unable to escape through the highly impermeable overcoat layer and tends to migrate into the support. The support is typically a polyester, most usually poly(ethylene terephthalate), and migration of the alcohol into such a support causes a highly undesirable width-wise curl which makes the imaging element very difficult to handle. A serious consequence of such width-wise curl, even though it may be very slight in extent, is jamming of processing equipment.

The problem of unwanted curl can be reduced by use of the adhesion-promoting interlayer of U.S. Pat. No. 4,942,115, but this approach can result in adverse sensitometric effects and requires an additional coating step which makes it economically less attractive.

Unwanted curl can also be reduced by incorporating a pre-hydrolyzed polyalkoxysilane in the imaging composition as described in the aforesaid copending commonly-assigned U.S. patent application Ser. No. 08/020,911, filed Feb. 22, 1993, "Method For The Manufacture Of A Thermally Processable Imaging Element" by Wojciech M. Przezdziecki and Jean Z. DeRuyter. By utilizing a pre-hydrolyzed polyalkoxysilane, the by-products of hydrolysis, such as the ethyl alcohol that is formed by hydrolysis of tetraethoxysilane, are not present in the image-forming layer and thus the problems caused by their migrating into the support are avoided. However, this method requires very exacting control of all process parameters.

It is toward the objective of providing an improved thermally processable imaging element which includes means to prevent the migration of hydrolysis by-products into the support that the present invention is directed.

SUMMARY OF THE INVENTION

In accordance with this invention, a thermally processable imaging element is comprised of:

(1) a support;

(2) a thermographic or photothermographic imaging layer which comprises a polyalkoxysilane;

(3) an overcoat layer overlying the imaging layer; and (4) a barrier layer interposed between the support and the imaging layer, the barrier layer being comprised of poly(silicic acid) and a water-soluble hydroxyl-containing monomer or polymer.

The overcoat layer utilized in the thermally processable imaging elements of this invention performs several important functions as hereinabove described. It can be composed of hydrophilic colloids such as gelatin or poly(vinyl alcohol) but is preferably composed of poly(silicic acid) and a water-soluble hydroxyl-containing monomer or polymer as described in U.S. Pat. No. 4,741,992, issued May 3, 1988.

In addition to the support, the imaging layer, the overcoat layer and the barrier layer, the thermally processable imaging element of this invention can optionally include additional layers such as a subbing layer and a backing layer. Particularly useful subbing layers are the polymeric adhesion-promoting layers described in U.S. Pat. No. 4,942,115, issued Jul. 17, 1990. As disclosed in the '115 patent, preferred adhesion-promoters are terpolymers of 2-propenenitrile, 1,1-dichloroethene and propenoic acid and terpolymers of the methyl ester of 2-propenoic acid, 1,1-dichloroethene and itaconic acid. Particularly useful backing layers are those comprising poly(silicic acid) and a water-soluble hydroxyl-containing monomer or polymer that is compatible therewith as described in U.S. Pat. No. 4,828,971, issued May 9, 1989. Thus, the improved thermally processable imaging element of this invention can contain three different layers each of which is comprised of poly(silicic acid), namely, (1) an overcoat layer whose purpose is to protect the element as described in U.S. Pat. No. 4,741,992, (2) a backing layer whose purpose is to improve conveyance, reduce static electricity and eliminate formation of Newton Rings as described in U.S. Pat. No. 4,828,971 and (3) a barrier layer whose purpose is to protect the support against migration from the imaging layer of hydrolysis by-products and thereby prevent width-wise curl as described herein.

A barrier layer formed from a combination of poly(silicic acid) and a water-soluble hydroxyl-containing monomer or polymer has been found to provide excellent barrier properties which prevent hyrolysis by-products, such as the ethyl alcohol formed by hydrolysis of tetraethoxysilane, from migrating into the support. This effectively avoids the problem of width-wise curl that can cause such serious difficulties as jamming of processing equipment.

DESCRIPTION OF THE PREFERRED EMBODIMENTS

The thermally processable imaging element of this invention can be a black-and-white imaging element or a dye-forming imaging element. It must have incorporated in the imaging layer a polyalkoxysilane whose function is to promote effective adhesion between the imaging layer and the protective overcoat layer.

Typical imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, 30 for example, U.S. Pat. Nos. 3,457,075; 4,459,350; 4,264,725 and 4,741,992 and *Research Disclosure*, June 1978, Item No. 17029.

Polyalkoxysilanes useful in this invention include those represented by the formulae I or II as follows:

$$Si(OR_1)_4 \qquad \text{I}$$

$$R_2\text{-}Si(OR_3)_3 \qquad \text{II}$$

wherein $R_1$ and $R_3$ are individually unsubstituted or substituted alkyl containing 1 to 4 carbon atoms, such as methyl, ethyl, propyl and butyl, and $R_2$ is unsubstituted or substituted alkyl, such as alkyl containing 1 to 22 carbon atoms, such as methyl, ethyl, propyl, butyl, and n-octadecyl; or unsubstituted or substituted phenyl.

Specific examples of useful polyalkoxysilanes for the purpose of this invention include:

$Si(OC_2H_5)_4$ $Si(OCH_3)_4$ $C_6H_5Si(OC_2H_5)_3$ $C_6H_5Si(OCH_3)_3$ $NH_2CH_2CH_2CH_2Si(OC_2H_5)_3$ $NH_2CH_2CH_2CH_2Si(OCH_3)_3$

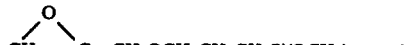

and $CH_3(CH_2)_{17}Si(OC_2H_5)_3$.

The polyalkoxysilane can be incorporated in the imaging layer in any amount that is effective to improve the adhesion between the imaging layer and the overcoat layer. As described in U.S. Pat. No. 4,886,739, issued Dec. 12, 1989, good results are obtained by utilizing the polyalkoxysilane in amounts of 2.5 to 20% by weight of the imaging layer. As also described in U.S. Pat. No. 4,886,739, it is believed that cross-linking reactions take place between hydrolysis products of the polyalkoxysilane and the binders that are present in both the imaging layer and the overcoat layer.

The thermally processable imaging element of this invention comprises at least one overcoat layer the element. The overcoat preferably comprises at least one polymer that contains hydroxyl groups that will react with the polyalkoxysilane in the contiguous imaging layer. This enables increased adhesion between the imaging layer and the contiguous overcoat layer.

The optimum layer thickness of the imaging layer and any contiguous layer, such as an overcoat layer, depends upon various factors, such as the particular element, processing conditions, thermal processing means, desired image and the particular components of the layers. A particularly useful imaging layer thickness is typically within the range of 1 to 10 microns, preferably 3 to 7 microns. A particularly useful overcoat layer thickness is also typically within the range of 1 to 10 microns, preferably 1 to 3 microns.

Useful overcoat compositions are typically transparent and colorless. If the overcoat is not transparent and colorless, then it is necessary, if the element is a photothermographic element, that it be at least transparent to the wavelength of radiation employed to provide and view the image. The overcoat does not significantly adversely affect the imaging properties of the element, such as the sensitometric properties in the case of a photothermographic element, such as minimum density, maximum density, or photographic speed.

The overcoat composition preferably comprises 50 to 90% by weight of the overcoat of poly(silicic acid) and comprises a water-soluble hydroxyl-containing polymer or monomer that is compatible with the poly(silicic acid). Such an overcoat composition is described in, for example, U.S. Pat. No. 4,741,992. Examples of water soluble hydroxyl-containing polymers are acrylamide polymers, water-soluble cellulose derivatives, hydroxy ethyl cellulose, water-soluble cellulose acetate, and poly(vinyl alcohol). Partially hydrolyzed poly(vinyl alcohols) are preferred.

Thermally processable imaging elements as described can contain multiple polymer-containing layers, such as multiple overcoat layers. For example, the thermally processable imaging element can contain a first overcoat layer comprising a polymer other than poly(silicic acid), such as a cellulose derivative, and a second overcoat layer comprising poly(silicic acid) and poly(vinyl alcohol).

A preferred overcoat comprises 50 to 90% by weight of poly(silicic acid) represented by the formula:

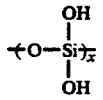

wherein x is an integer within the range of at least 3 to about 600 and wherein the overcoat also comprises 10 to 50% poly(vinyl alcohol).

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure*, December 1978, Item No. 17029 and *Research Disclosure*, June 1978, Item No. 17643. Tabular grain photosensitive silver halide is also useful, as described in, for example, U.S. Patent No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Patent No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bisbeta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,381. Examples of useful sulfonamidophenol reducing agents are 2,6-dichloro-4-benzenesulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable element can comprise a variety of supports. Examples of useful supports are poly(vinylacetal) film, polystyrene film, poly(ethyleneterephthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis(tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

As hereinabove described, the improved thermally processable imaging element of this invention includes a barrier layer interposed between the support and the imaging layer. The purpose of the barrier layer is to prevent components of the imaging layer, such as by-products of the hydrolysis of the polyalkoxysilane that is incorporated in the imaging composition, from migrating into the support and causing width-wise curl. The barrier layer is comprised of poly(silicic acid) as hereinabove described and, as also hereinabove described, a water-soluble hydroxyl-containing monomer or polymer. The barrier layer preferably comprises 50 to 90% by weight of the poly(silicic acid) and 10 to 50% by weight of the hydroxyl-containing monomer or polymer. Most prferably, the barrier layer is comprised of a mixture of poly(silicic acid) and poly(vinyl alcohol).

The barrier layer typically has a thickness in the range of form 1 to 10 microns and preferably from 1 to 3 microns. It is ordinarily not necessary to incorporate matting agents in the barrier layer although they are typically employed in a poly(silicic acid) overcoat layer and in a poly(silicic acid) backing layer.

The invention is further illustrated by the following examples of its practice. In these examples, tetraethoxysilane is referred to as "TEOS".

EXAMPLES 1-3

A photothermographic composition was prepared by coating a poly(ethylene terephthalate) film support on one surface with a backing layer and coating it, in order, on the opposite surface with a subbing layer, a barrier layer, an imaging layer and an overcoat layer. The backing layer contained poly(silicic acid), poly(vinyl alcohol) and methylmethacrylate beads and was the same as that described in Example 1 of U.S. Pat. No. 4,828,971, issued May 9, 1989. The subbing layer contained poly(2-propenenitrile-co-1,1-dichloroethene-co-2-propenoic acid) and was the same as that described in Example 1 of U.S. Pat. No. 4,942,115, issued Jul. 17, 1990. The barrier layer contained poly(silicic acid) and poly(vinyl alcohol) in a ratio of 1.25 parts of poly(silicic acid) per part by weight of poly(vinyl alcohol) and was coated in an amount of 340 milligrams per square meter. The imaging layer contained TEOS and was the same as that described in Example 1 of U.S. Pat. No. 4,886,739 except that the TEOS was present in an amount of 1.5 grams per square meter. The overcoat layer contained poly(silicic acid) and poly(vinyl alcohol) and was the same as that described in Example B of Table I of U.S. Pat. No. 4,741,992.

A second element, identified as Example 2, was prepared in which the only difference from Example 1 was that the barrier layer was coated at fifty percent of the coating weight of the barrier layer of Example 1. A third element, identified as Example 3, was prepared in which the only difference from Example 1 was that the barrier layer was coated at twenty-five percent of the coating weight of the barrier layer of Example 1. For purposes of comparison, a control element, identified as Control A, was prepared so that it was identical to Example 1 except that the barrier layer was omitted.

Each of the four elements described above was exposed and processed and then evaluated in an adhesion test using test tapes $T_1$, $T_2$ and $T_3$ as follows:

| Tape* | Bonding Strength (g/1.9 cm) |
|---|---|
| $T_1$ - SCOTCH Magic Tape #811 | 25 |
| $T_2$ - SCOTCH Magic Tape #810 | 250 |
| $T_3$ - HIGHLAND 3M 5910 Transparent Tape | 450 |

*These tapes are sold by Minnesota Mining and Manufacturing Company

In the adhesion test, the tape was laminated to the sample and then pulled off at an angle of approximately 180 degrees. The surface was examined and rated in accordance with the following ratings:

S-stripping
PS-partial stripping
NS-no stripping

Each of the four elements described above was also evaluated with respect to its curling characteristics using a test method of the American National Standards Institute, Inc. identified as ANSI Test PH1.29-1971 for determining the curl of photographic film. The curl values reported each represent an average of four tests. Additional testing was carried out with respect to sensitometric characteristics, namely photographic speed, $D_{max}$ and $D_{min}$, measured on fresh film, film that had been stored for two weeks at 50° C. and 15% relative humidity and film that had been stored for two weeks at 38° C. and 50% relative humidity. Results of the adhesion and curl measurements are reported in Table I below while results of the sensitometric measurements are reported in Table II.

TABLE I

| Test No. | ANSI Curl | Adhesion Test $T_1$ | $T_2$ | $T_3$ |
|---|---|---|---|---|
| Example 1 | 5 | NS | NS | NS |
| Example 2 | 7 | NS | NS | NS |
| Example 3 | 8 | NS | NS | NS |
| Control A | 14 | NS | NS | NS |

TABLE II

| Test No. | Fresh Speed | Fresh $D_{max}$ | Fresh $D_{min}$ | 50° C./15% RH Speed | 50° C./15% RH $D_{max}$ | 50° C./15% RH $D_{min}$ | 38° C./50% RH Speed | 38° C./50% RH $D_{max}$ | 38° C./50% RH $D_{min}$ |
|---|---|---|---|---|---|---|---|---|---|
| Example 1 | 310 | 3.2 | 0.15 | 314 | 3.2 | 0.26 | 297 | 3.3 | 0.13 |
| Example 2 | 313 | 3.2 | 0.16 | 313 | 3.3 | 0.18 | 299 | 3.3 | 0.14 |
| Example 3 | 297 | 3.4 | 0.17 | 311 | 3.7 | 0.18 | 299 | 3.7 | 0.14 |
| Control A | 295 | 3.3 | 0.18 | 294 | 3.1 | 0.16 | 273 | 3.3 | 0.14 |

As indicated by the data in Table I, the photothermographic films of Examples 1 to 3, which include a barrier layer in accordance with this invention, exhibit much lower curl values than the photothermographic film of Control A which contained no barrier layer. All four of the films exhibited good results in the adhesion test. These results indicate that the barrier layer is effective in preventing migration into the support of by-products resulting from hydrolysis of the polyalkoxysilane.

As indicated by the data in Table II, having the barrier layer over the subbing layer as in Examples 1 to 3 provides higher speed than that exhibited by Control A. In particular, the subbing layer tends to cause a speed loss and this is prevented by use of the barrier layer.

EXAMPLE 4

A photothermographic element was prepared using production scale equipment. The element was the same as that described in Examples 1 to 3 except that the imaging layer contained TEOS in an amount of only 0.5 grams per square meter. For purposes of comparison, control elements B, C and D were also prepared. Control B differed from Example 4 in that the barrier layer was omitted. Control C differed from Example 4 in that the barrier layer was omitted and no TEOS was included in the imaging layer. Control D differed from Example 4 in that the barrier layer was omitted, no TEOS was included in the imaging layer and the subbing layer was omitted.

Each of the four elements described above was exposed and processed and evaluated for adhesion, curl characteristics and sensitometric characteristics in the manner described hereinabove. Results of the adhesion and curl measurements are reported in Table III. Curl measurements reported are an average of six and include values for curl after the element was heated for 24 hours at 60° C. Adhesion tests were carried out on both raw stock and processed film. Results of the sensitometric tests which were carried out on fresh film, on film that had been stored for four weeks at 50° C. and 15% relative humidity and on film that had been stored for four weeks at 25° C. and 50% relative humidity are reported in Table IV.

TABLE III

| Test No. | ANSI Curl | ANSI Curl (60° C.) | Raw Stock Adhesion $T_1$ | Raw Stock Adhesion $T_2$ | Raw Stock Adhesion $T_3$ | Processed Film Adhesion $T_1$ | Processed Film Adhesion $T_2$ | Processed Film Adhesion $T_3$ |
|---|---|---|---|---|---|---|---|---|
| Example 4 | 7.3 ± 1.2 | 1.8 ± 0.7 | NS | NS | NS | NS | NS | NS |
| Control B | 14.7 ± 1.7 | 7.6 ± 1.2 | NS | NS | NS | NS | NS | NS |
| Control C | 5.3 ± 0.5 | 4.0 ± 1.7 | S | S | S | PS | PS | PS |
| Control D | 6 ± 1.0 | 2.8 ± 0.7 | S | S | S | .S | PS | PS |

TABLE IV

| Test No. | Fresh Speed | Fresh $D_{max}$ | Fresh $D_{min}$ | 50° C./15% RH Speed | 50° C./15% RH $D_{max}$ | 50° C./15% RH $D_{min}$ | 25° C./50% RH Speed | 25° C./50% RH $D_{max}$ | 25° C./50% RH $D_{min}$ |
|---|---|---|---|---|---|---|---|---|---|
| Example 4 | 300 | 3.5 | 0.17 | 291 | 3.4 | 0.18 | 299 | 3.4 | 0.23 |
| Control B | 286 | 3.3 | 0.14 | 278 | 2.8 | 0.15 | 280 | 3.2 | 0.16 |
| Control C | 283 | 3.3 | 0.12 | 276 | 2.7 | 0.15 | 278 | 3.1 | 0.14 |
| Control D | 299 | 3.5 | 0.12 | 294 | 3.3 | 0.14 | 294 | 3.1 | 0.13 |

As indicated by the data in Table III, the photothermographic film of Example 4, which included a barrier layer in accordance with this invention, exhibited both low curl and good adhesion. Control B, which omitted the barrier layer, exhibited good adhesion but poor curl. Controls C and D did not suffer from a curl problem because no TEOS was included in the imaging layer but, for this same reason, they exhibited poor adhesion characteristics.

As indicated by the data in Table IV, a speed loss occurred with Controls B and C due to adverse sensitometric effects of the presence of the subbing layer. This did not occur with Example 4 because the barrier layer protects the element against this adverse sensitometric effect and provides speed values comparable to those of Control D which omitted the subbing layer.

In summary, the experimental data establish that the barrier layer is not only effective in preventing curl caused by migration of hydrolysis by-products from the imaging layer into the support but is also effective in preventing adverse sensitometric effects resulting from the use of subbing layers. Use of a barrier layer in accordance with the invention facilitates the use of a polyalkoxysilane in the imaging layer to achieve the advantage of enhanced adhesion that this provides, while at the same time providing good sensitometric properties and freedom from an excessive level of unwanted curl. The barrier layer of the present invention is comprised of poly(silicic acid) and a water-soluble hydroxyl-containing monomer or polymer. These same ingredients can also be utilized to form one or both of a protective overcoat layer and a backing layer.

The invention has been described in detail, with particular reference to certain preferred embodiments thereof, but it should be understood that variations and modifications can be effected within the spirit and scope of the invention.

We claim:

1. A thermally processable imaging element, said element comprising:

(1) a support;

(2) a thermographic or photothermographic imaging layer; said imaging layer comprising a polyalkoxysilane;

(3) an overcoat layer overlying said imaging layer; and (4) a barrier layer interposed between said support and said imaging layer; said barrier layer being comprised of poly(silicic acid) and a water-soluble hydroxyl-containing monomer or polymer.

2. A thermally processable imaging element as claimed in claim 1 additionally comprising a backing layer on the side of said support opposite to said imaging layer.

3. A thermally processable imaging element as claimed in claim 2 wherein said backing layer is comprised of poly(silicic acid) and a water-soluble hydroxyl-containing monomer or polymer.

4. A thermally processable imaging element as claimed in claim 1 additionally comprising a subbing layer interposed between said support and said barrier layer.

5. A thermally processable imaging element as claimed in claim 4 wherein said subbing layer comprises a terpolymer of 2-propenenitrile, 1,1-dichloroethene and propenoic acid.

6. A thermally processable imaging element as claimed in claim 4 wherein said subbing layer comprises a terpolymer of the methyl ester of 2-propenoic acid, 1,1-dichloroethene and itaconic acid.

7. A thermally processable imaging element as claimed in claim 1 wherein said support is a poly(ethylene terephthalate) film.

8. A thermally processable imaging element as claimed in claim 1 wherein said imaging layer comprises:

(a) photographic silver halide, (b) an image-forming combination comprising (i) an organic silver salt oxidizing agent, with (ii) a reducing agent for the organic silver salt oxidizing agent, and (c) a toning agent.

9. A thermally processable imaging element as claimed in claim 1 wherein said polyalkoxysilane is represented by formula I or II as follows:

$$Si(OR_1)_4 \qquad \text{I}$$

$$R_2\text{-}Si(OR_3)_3 \qquad \text{II}$$

wherein $R_1$ and $R_3$ are individually unsubstituted or substituted alkyl containing 1 to 4 carbon atoms and $R_2$ is unsubstituted or substituted alkyl or phenyl.

10. A thermally processable imaging element as claimed in claim 1 wherein said polyalkoxysilane is $Si(OC_2H_5)_4$ $Si(OCH_3)_4$ $C_6H_5Si(OC_2H_5)_3$ $C_6H_5Si(OCH_3)_3$ $NH_2CH_2CH_2CH_2Si(OC_2H_5)_3$ $NH_2CH_2CH_2CH_2Si(OCH_3)_3$

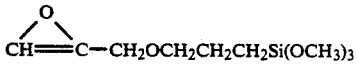

or $CH_3(CH_2)_{17}Si(OC_2H_5)_3$.

11. A thermally processable imaging element as claimed in claim 1 wherein said overcoat layer is comprised of poly(silicic acid) and a water-soluble hydroxyl-containing monomer or polymer.

12. A thermally processable imaging element as claimed in claim 1 wherein said imaging layer comprises a poly(vinyl butyral) binder.

13. A thermally processable imaging element as claimed in claim 1 wherein said imaging layer contains 2.5 to 20% by weight of said polyalkoxysilane.

14. A thermally processable imaging element as claimed in claim 1 wherein said polyalkoxysilane is tetraethoxysilane.

15. A thermally processable imaging element as claimed in claim 1 wherein said barrier layer comprises 50 to 90% by weight of poly(silicic acid) and 10 to 50% by weight of a water-soluble hydroxyl-containing monomer or polymer.

16. A thermally processable imaging element as claimed in claim 1 wherein said barrier layer comprises poly(vinyl alcohol) and poly(silicic acid) of the formula:

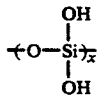

wherein x is an integer within the range of at least 3 to about 600.

17. A thermally processable imaging element as claimed in claim 1 wherein said imaging layer comprises:

(a) photographic silver halide, (b) an image-forming combination comprising (i) silver behenate, with (ii) a phenolic reducing agent for the silver behenate, (c) a succinimide toning agent, and (d) an image stabilizer.

18. A thermally processable imaging element as claimed in claim 1 wherein said barrier layer has a thickness of 1 to 3 microns.

19. A thermally processable imaging element, said element comprising a support having a backing layer on one side thereof and having on the opposite side, in order, a subbing layer, a barrier layer comprised of poly(silicic acid) and a water-soluble hydroxyl-containing monomer or polymer, a photothermographic imaging layer comprising a polyalkoxysilane, and an overcoat layer.

20. A thermally processable imaging element, said element comprising a poly(ethylene terephthalate) film support having a backing layer, comprised of poly(silicic acid) and poly(vinyl alcohol), on one side thereof and having on the opposite side, in order, a subbing layer comprising a terpolymer of 2-propenenitrile, 1,1-dichloroethene and propenoic acid; a barrier layer comprised of poly(silicic acid) and poly(vinyl acohol); a photothermographic imaging layer comprising poly(vinyl butyral), photographic silver halide, silver behenate, a phenolic reducing agent, a tetraethoxysilane, and an overcoat layer comprised of poly(silicic acid) and poly(vinyl alcohol).

* * * * *